United States Patent [19]

Stokman et al.

[11] Patent Number: 5,052,922

[45] Date of Patent: Oct. 1, 1991

[54] CERAMIC GAS BURNER FOR A HOT BLAST STOVE, AND BRICKS THEREFOR

[75] Inventors: Ronald J. M. Stokman, Hillegom; Johannes J. De Wit, Obdam, both of Netherlands

[73] Assignee: Hoogovens Groep BV, IJmuiden, Netherlands

[21] Appl. No.: 539,590

[22] Filed: Jun. 18, 1990

[30] Foreign Application Priority Data

Jun. 27, 1989 [NL] Netherlands ..... 8901620

[51] Int. Cl.[5] ..... F24H 1/00

[52] U.S. Cl. ..... 432/181; 432/182; 432/217

[58] Field of Search ..... 432/175, 176, 181, 182, 432/217

[56] References Cited

U.S. PATENT DOCUMENTS

| | | | |
|---|---|---|---|
| 3,627,284 | 12/1971 | Van Laar | 432/217 |
| 4,259,064 | 3/1981 | Laux et al. | 432/217 |
| 4,313,724 | 2/1982 | Muller et al. | 432/217 |
| 4,353,688 | 10/1982 | Ahner et al. | 432/217 |
| 4,378,045 | 3/1983 | Balke et al. | 432/181 |
| 4,392,824 | 7/1983 | Struck et al. | 432/181 |
| 4,582,485 | 4/1986 | White, Jr. | 432/30 |
| 4,824,364 | 4/1989 | Kobani et al. | 432/182 |
| 4,881,895 | 11/1989 | Felthuis et al. | 432/181 |

*Primary Examiner*—Henry C. Yuen

*Attorney, Agent, or Firm*—Stevens, Davis, Miller & Mosher

[57] ABSTRACT

A ceramic gas burner for a hot-blast stove has a burner crown essentially composed of a plurality of shaped bricks which define terminal portions of at least one combustion air duct and at least one gas duct of said burner for flow of respectively combustion air and gas. A simple and inexpensive structure is obtained when the bricks are of at most two principal types in respective layers. The bricks of each type are identical, but may be of a subsidiary type of which two bricks combine to form one brick of the principal type.

19 Claims, 3 Drawing Sheets

CERAMIC GAS BURNER FOR A HOT BLAST STOVE, AND BRICKS THEREFOR

BACKGROUND OF THE INVENTION

1. Field of the Invention

The invention relates to a ceramic gas burner for a hot blast stove e.g. of a blast furnace, comprising a burner crown essentially composed of a plurality of shaped bricks which define terminal portions of air and gas ducts.

2. Description of the Prior Art

A burner as described above is known for example from NL-A-8702037, corresponding to U.S. Pat. No. 4,863,378. Because of the high thermal loading to which this kind of burner is exposed, its service life is generally much shorter than the service life of the hot blast stove in which it is installed. Repairing a burned-out burner is costly, and to a large extent this is related to the complex construction of the known burner. In fact the known burner is formed of over fifty different shaped bricks which each have to be placed precisely in their correct places. This means that the construction or reconstruction of such a burner is a job which must be carried out by highly qualified people. The complexity of the known burner also means that the construction or repair time lasts a considerable number of days, in general at least fifteen working days. Much of the costs of a repair are caused by the long downtime of the hot blast stove.

As background to the present invention, mention is made of other burner designs for hot blast stoves disclosed in EP-A-306072, DE-A-3240852, GB-A-2017290 and U.S. Pat. No. 3,568,932.

SUMMARY OF THE INVENTION

An object of the invention is to provide a solution to the problems described above, so that at least the repair of a hot blast stove burner can be simpler and less expensive. Construction costs may also be reduced.

The ceramic gas burner in accordance with the invention is characterized in that the burner crown is essentially composed of shaped bricks of at most two principal types.

It is possible to envisage many ways in which two types only of shaped bricks may be designed, for the burner crown construction. However, the preferred solution has been found to be that the bricks of a first one of the principal types is essentially rectangular in shape, with at least one of the dimensions of the top face of the brick being smaller than the bottom face of the same bricks. The brick of the second principal type is essentially trapezoidal in shape as seen in vertical section and has a bottom face of which the dimensions are essentially equal to the dimensions of the top face of the shaped brick of the first principal type.

In more detail, the brick of the first principal type has generally parallel top and bottom faces and four side faces which one perpendicular to the bottom face over a part of the brick height. Suitably this brick is rectangular in plan view.

The bricks of the second principal type in this embodiment have top and bottom faces generally parallel to each other and four side faces of which three are generally perpendicular to the bottom face while the fourth is oblique so that the brick tapers upwardly. The brick of the first principal type may also taper upwardly over part of its height. With the bricks of the second principal type in a layer on top of a layer of the bricks of the first principal type, the burner crown may then have an upwardly widening opening into which the combustion air and the gas flows are discharged. This arrangement may be symmetrical about a vertical plane, with two air ducts in the burner below the crown on either side of a central gas duct below the crown.

In order that a burner constructed with such bricks may meet expected performance requirements, the brick of the first principal type is preferably provided with at least one groove-shaped recess suitable for conducting combustion gas. Further at least one of the principal types of brick is preferably provided with at least one passage through it for conducting the combustion air.

Preferably the passage for conducting combustion air in the brick of the first principal type is in line with a recess for conducting combustion air in the brick of the second principal type which lies directly above the brick of the first principal type. This has the advantage that a repair or reconstruction of a burner may be carried out simply by first bringing into the hot blast stove all the bottom layer bricks and fitting them accurately, whereafter the burner may be completed by fitting the distinctly different bricks of the top layer. For this the bricks have to be placed in such a way that the bottom face of each brick of the second principal type lies on the top face of each brick of the first principal type. Both types of brick are of handy size and acceptable weight which makes them easy to handle and enables fast construction.

In practice it has been found very desirable that the dimensions of the passage for the combustion air may be adjusted in order to achieve a certain desired combustion characteristic of the burner. With the known burner which is composed of many different shaped bricks, such an adjustment is not practical to carry out easily. With the burner in accordance with the invention, however, it is possible to achieve adjustment of the dimensions of the combustion air duct in a very simple way by minor adjustment of the dimensions of those two principal types of bricks which are relevant to the combustion air duct.

In principle, the bricks of the first principal type are all identical and the bricks of the second principal type are all identical. However, it may be desirable that each of the principal types of bricks has a secondary or subsidiary brick type, consisting of identical bricks which are a fraction of the principal type and are adapted for producing a composite brick by assembling with one or more further bricks of the same subsidiary type, the dimensions of the composite brick being essentially equal to the dimensions of the brick of the principal type from which the subsidiary type is derived. Burners which have an uneven number of outlet openings for air may also be made in accordance with the invention with the aid of such subsidiary type bricks.

Preferably each of the bricks of at least one principal type is provided with at least one groove in a side face, which groove in the assembled burner adjoins a side face of a neighbouring brick of the same principal type. Particularly if the grooves of the neighbouring bricks form a through-hole, then a ceramic cord may be placed in the groove or grooves which ensures that the bricks of the same principal type are extremely well secured to each other.

It is further desirable that the bricks of the respective different principal types are located relative to each other by cooperating recesses and projections of the bricks.

The invention further consists in a set of shaped bricks as described, for forming the crown of the ceramic burner in accordance with the invention.

BRIEF INTRODUCTION OF THE DRAWINGS

The invention will now be illustrated by way of non-limitative example, with reference to the accompanying drawings, in which:

FIG. 1 is a top view of a ceramic gas burner of a hot blast stove, in accordance with the invention, FIG. 2 shows a vertical section of the crown of the burner on the line A—A in FIG. 1, FIG. 3 shows a shaped brick used for the bottom layer of the burner crown of FIG. 1 (brick of the first principal type). FIG. 3*a* is a side view of the brick, FIG. 3*b* is a top view, FIGS. 3*c* and 3*e* are opposite end views and FIG. 3*d* is a section on line A—A of FIG. 3*b*.

FIG. 4 shows a shaped brick used for the top layer of the burner crown of FIG. 1 (second principal type).

FIG. 5 shows a shaped brick of a subsidiary type of the first principal type.

FIG. 6 shows a shaped brick of a subsidiary type of the second principal type.

DESCRIPTION OF THE PREFERRED EMBODIMENT

Figure 1:
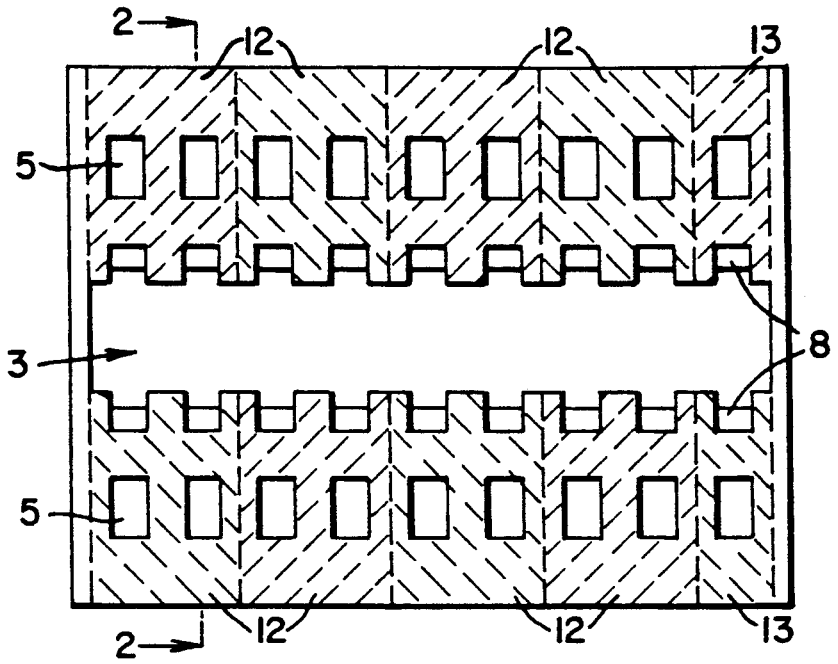

In the several figures, the same reference numbers refer to the same parts.

The arrangement and use of the gas burner in the combustion chamber of a hot blast stove is well known to those skilled in the technical field and so needs no further explanation here. Reference may be made for example to the patent specifications mentioned above.

In the present embodiment, combustion gas is passed through a central feeder duct 1 in the burner to the burner crown 6 and flows out at the upwardly widening outlet opening 3 into the combustion chamber of the hot blast stove. In top view (FIG. 1) the outlet opening 3 has a rectangular slot shape. Two oblique bounding faces 10 (see FIG. 2) of the burner crown extend outward and upwards at an angle to the vertical, to define the outlet opening 3. The side walls 11 of the combustion chamber are partly shown in FIG. 2, but not shown in FIG. 1.

At each side of the gas feeder duct 1 there are combustion air feeder ducts 2 which discharge at second outlet openings 5 via angled passages 4. These air outlet openings 5 form two series, one on each side of first outlet opening 3.

The top end of the burner is thus the crown 6 defining the terminal portions of the air and gas ducts. Below the crown, the ducts 1,2 are parallel and vertical.

The passages 4 extend through the burner crown 6 built into the wall 11 of the combustion chamber. The crown is further bounded by the faces 10. There are grooves 9 in the burner crown 6 forming ducts 8 with a square cross-section. The grooves 9 open out into the passages 4 at the outlet openings 5. At the outlet opening 3 of gas feeder duct 1, the duct 8 forms a rectangular recess. As shown in FIG. 1, opposite each of the air outlet openings 5 there lies a recess 8 formed by grooves 9.

Combustion air coming out of the outlet openings 5 does not blow through the central gas flow, but flows towards it and along it.

The crown 6 defining the terminal duct parts 3,4,5 and 8 is composed of shaped ceramic bricks 12,13,14,15 arranged in two layers 20,21. Apart from their shapes, these refractory bricks are of a conventional nature for such a burner. The bricks are of only two principal types, each principal type having one subsidiary type as described below. All the bricks of each type are identical, with the brick of a subsidiary type being a fraction, in this case half, of a brick of the corresponding principal type.

FIG. 1 shows in top view the bricks 12,13 of the top layer 21. The boundary between the bricks is indicated by broken lines.

Figure 2:
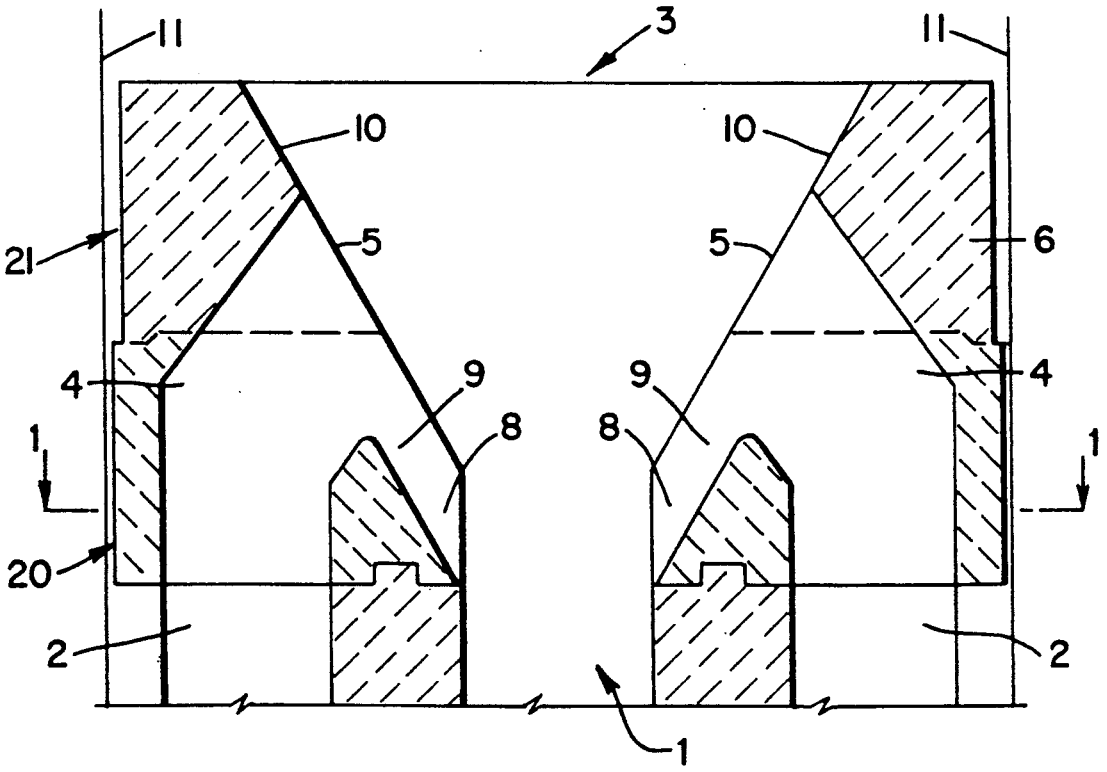
Figure 3B:
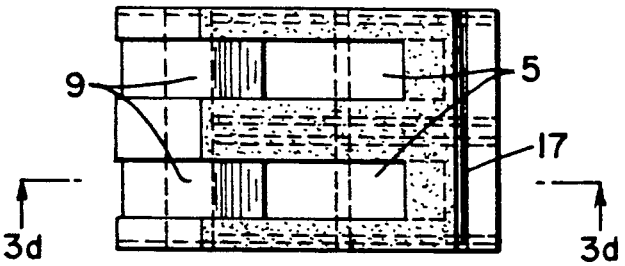
Figure 3C:
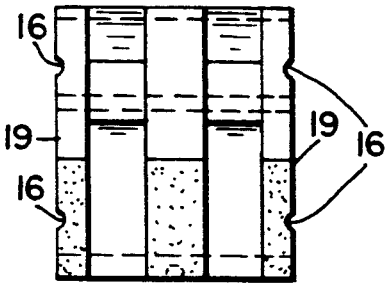
Figure 3A:
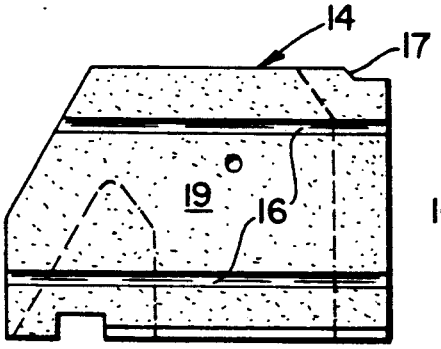
Figure 3E:
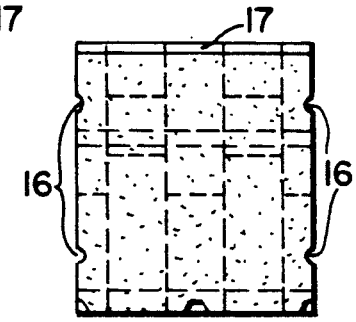
Figure 3D:
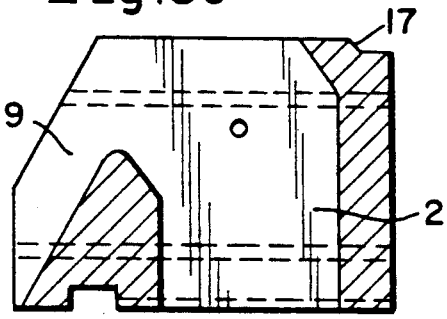

FIG. 2 shows the different nature of the bottom layer 20 and top layer 21 of the burner crown 6 and here too the boundary faces are indicated by broken lines.

Figure 4B:
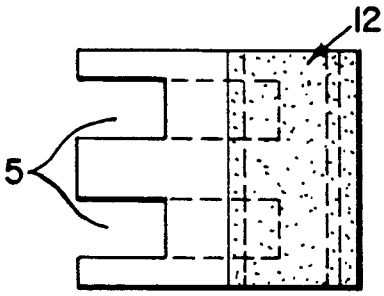
FIG. 4*b* is a top view and FIG. 4*c* is an end view from the left side of FIG. 4*a*.
Figure 4C:
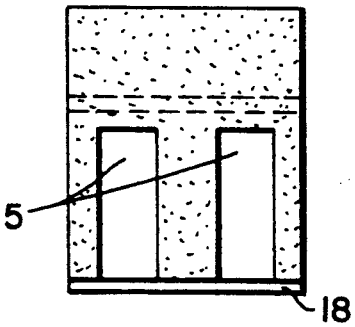
Figure 4A:
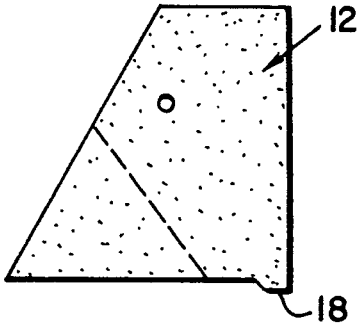
FIG. 4*a* is a side view of the brick.
Figure 5B:
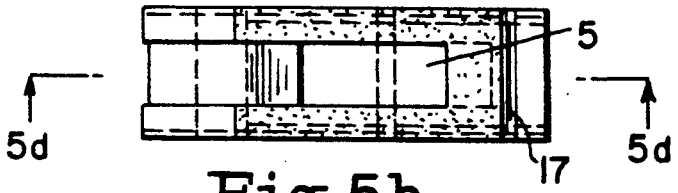
FIG. 5*b* is a top view.
Figure 5C:
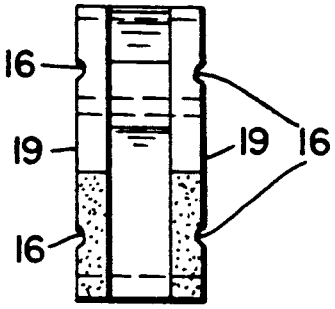
FIGS. 5*c* and 5*e* are opposite end views and FIG. 5*d* is a section on line A—A of FIG. 5*b*.
Figure 5A:
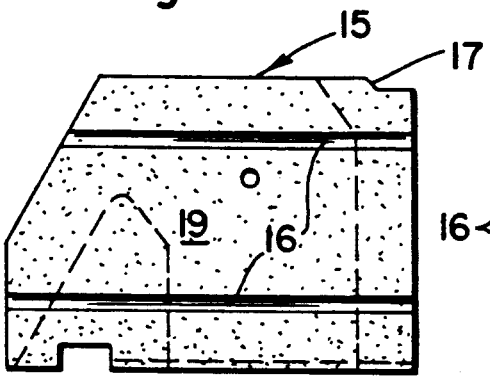
FIG. 5*a* is a side view of the brick.
Figure 5E:
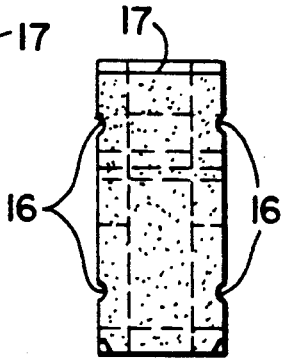
Figure 5D:
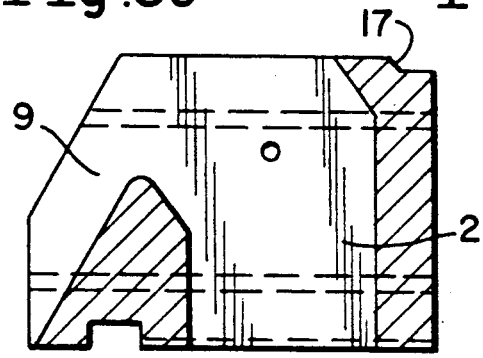
Figure 6B:
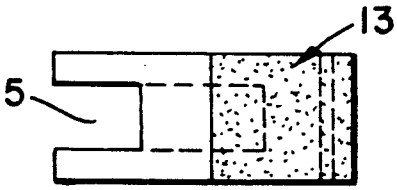
FIG. 6*b* is a top view and FIG. 6*c* is an end view from the left side of FIG. 6*a*.
Figure 6C:
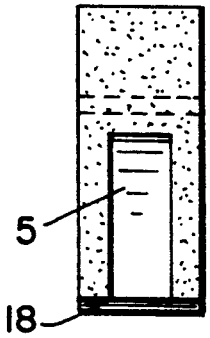
Figure 6A:
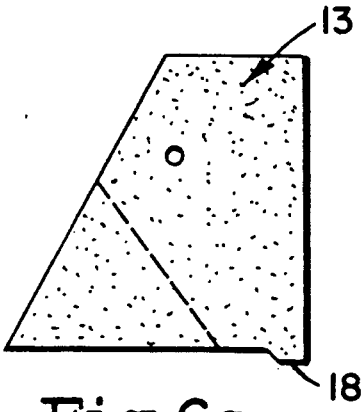
FIG. 6*a* is a side view of the brick.

The shaped bricks 14 (see FIG. 3) of the first of the two principal types form the bottom layer 20 of the burner crown. Likewise intended for the bottom layer of the burner, the subsidiary type 15 corresponding to the principal type 14 is shown in FIG. 5. Furthermore, FIG. 4 shows the second principal type of brick 12 and FIG. 6 shows a corresponding subsidiary type 13. These bricks 12,13 form the top layer 21 of the crown 6.

The dimensions of the subsidiary types 15 and 13 are such that, when placed side by side, two examples of the same subsidiary type have together dimensions which correspond with those of the corresponding principal type 14 and 12 respectively. Since each brick 12,14 has two air outlet openings 5, with the subsidiary types 13,15 burners may be made with an uneven number of air outlet openings 5.

FIGS. 3 to 6 show the shapes of these bricks 12,13,14,15 in detail. The general outline of the brick 14 of FIG. 3 is cuboid, but one side face is oblique over part of the height, so that the top face is smaller in one dimension than the bottom face. Cut into this general outline are the grooves 9 and passages 4, each brick 14 having two grooves 9 and two passage 4. At the lower portion of the brick 14, the four side faces are perpendicular to the bottom face.

The general outline of the brick 12 of FIG. 5 is trapezoidal, with three vertical side faces and one oblique side face. The dimensions of the bottom face of the brick 12 are almost exactly equal to those of the top face of the brick 14 on which the brick 12 sits. Grooves to form the outlet openings 5 of the passages 4 are cut into the general outline of the brick 12, and are aligned with the grooves 9 and passages 4 of the brick 14.

The bricks 14 and 15 of the bottom layer 20 of the burner crown have small grooves 16 in the side walls 19 which adjoin neighbouring bricks in the layer 20. After the bottom layer of the burner crown has been composed with the bricks 14 and where necessary the bricks 15, a ceramic cord may be placed in the through holes formed by the grooves 16 for the purpose of securing these bricks together (not shown in drawing). The bricks 14,15 are further provided with a recess 17 which cooperates with projections 18 of the shaped bricks 12,13 for the top layer 21, to locate the shaped bricks of the top layer 20 and the bottom layer 21 of the burner crown 6.

FIGS. 1 and 2 show that the arrangement of the bricks 12,13,14,15 is symmetrical about a vertical central plane extending longitudinally of the slot-shaped opening 3.

What is claimed is

1. A ceramic gas burner for a hot-blast stove comprising a burner crown essentially composed of a plurality of shaped bricks which define terminal portions of at least one combustion air duct and at least one gas duct of said burner for flow of respectively combustion air and gas, said bricks being of at most two principal types and said bricks of one of said principal types are located relative to said bricks of the other said principal type by cooperating projections and recesses on the bricks.

2. A ceramic gas burner for a hot-blast stove comprising a burner crown essentially composed of a plurality of shaped bricks which define terminal portions of at least one combustion air duct and at least one gas duct of said burner for flow of respectively combustion air and gas, wherein said bricks are of a first principal type in a first layer and a second said principal type in a second layer on top of said first layer, said bricks of said first principal type having a general outline shape consisting of generally parallel top and bottom faces and four side faces, said side faces being perpendicular to said bottom face over a part of the height of the brick and said top face being smaller in at least one dimension than said bottom face, said bricks of said second principal type having an upwardly tapering trapezoidal shape as seen in vertical cross-section, having generally parallel top and bottom faces.

3. A ceramic gas burner according to claim 2, wherein each of said bricks of at least one of said principal types has at least one passage through it for said combustion air.

4. A ceramic gas burner according to claim 3, wherein said bricks of said first principal type have said passages through them for combustion air and said bricks of said second principal type each having at least one groove-shaped recess for said combustion air, said groove-shaped recesses being aligned with said passages.

5. A ceramic gas burner according to claim 2 wherein each said brick tapers upwardly over at least a part of its height, whereby the assembled bricks in said burner crown define an upwardly widening opening into which said combustion air flow and said gas flow are discharged.

6. A ceramic gas burner according to claim 2 wherein said bricks of at least one of said principal types each has at least one groove-shaped recess for said gas.

7. A ceramic gas burner according to claim 2 wherein a plurality of said bricks of at least one of said principal types are of a subsidiary type of the respective principal type, each said brick of the subsidiary type being shaped to form a composite brick by assembling it with another said brick of the subsidiary type, said composite brick having dimensions essentially equal to the dimensions of the brick of the respective principal type.

8. A ceramic gas burner according to claim 2 wherein each of said bricks of at least one of said principal types has a side face having at least one groove, said side face adjoining a neighbouring brick of the same principal type.

9. A ceramic gas burner according to claim 8 wherein said grooves of two neighbouring bricks combine to form a hole.

10. A ceramic gas burner according to claim 9 having a ceramic cord located in said hole.

11. Ceramic gas burner according to claim 2 wherein said bricks of one of said principal types are located relative to said bricks of the other said principal types by cooperating projections and recesses on the bricks.

12. Ceramic gas burner according to claim 3 wherein said bricks of one of said principal types are located relative to said bricks of the other said principal type by cooperating projections and recesses on the bricks.

13. Ceramic gas burner according to claim 4 wherein said bricks of one of said principal types are located relative to said bricks of the other said principal type by cooperating projections and recesses on the bricks.

14. Ceramic gas burner according to claim 5 wherein said bricks of one of said principal types are located relative to said bricks of the other said principal type by cooperating projections and recesses on the bricks.

15. Ceramic gas burner according to claim 6 wherein said bricks of one of said principal types are located relative to said bricks of the other said principal type by cooperating projections and recesses on the bricks.

16. Ceramic gas burner according to claim 7 wherein said bricks of one of said principal types are located relative to said bricks of the other said principal type by cooperating projections and recesses on the bricks.

17. Ceramic gas burner according to claim 8 wherein said bricks of one of said principal types are located relative to said bricks of the other said principal type by cooperating projections and recesses on the bricks.

18. Ceramic gas burner according to claim 9 wherein said bricks of one of said principal types are located relative to said bricks of the other said principal type by cooperating projections and recesses on the bricks.

19. Ceramic gas burner according to claim 10 wherein said bricks of one of said principal types are located relative to said bricks of the other said principal type by cooperating projections and recesses on the bricks.

* * * * *